US010173094B2

(12) United States Patent
Gomberg et al.

(10) Patent No.: US 10,173,094 B2
(45) Date of Patent: Jan. 8, 2019

(54) ADJUSTABLE REHABILITATION AND EXERCISE DEVICE

(71) Applicant: ROM3 Rehab LLC, Las Vegas, NV (US)

(72) Inventors: Sanford Gomberg, Las Vegas, NV (US); Peter Arn, Pasadena, CA (US); William J. Rehlich, San Francisco, CA (US); Sean P. Allison, York, PA (US)

(73) Assignee: ROM3 REHAB LLC, Las Vegas, NV (US)

( * ) Notice: Subject to any disclaimer, the term of this patent is extended or adjusted under 35 U.S.C. 154(b) by 0 days.

(21) Appl. No.: 15/700,293

(22) Filed: Sep. 11, 2017

(65) Prior Publication Data

US 2018/0071565 A1 Mar. 15, 2018

Related U.S. Application Data

(60) Provisional application No. 62/393,348, filed on Sep. 12, 2016.

(51) Int. Cl.
*A63B 22/00* (2006.01)
*A63B 22/06* (2006.01)
(Continued)

(52) U.S. Cl.
CPC .... *A63B 22/0015* (2013.01); *A63B 21/00069* (2013.01); *A63B 21/015* (2013.01); *A63B 22/0002* (2013.01); *A63B 22/0046* (2013.01); *A63B 22/0605* (2013.01); *A63B 69/16* (2013.01); *A63B 21/225* (2013.01);
(Continued)

(58) Field of Classification Search
CPC ..... A63B 21/00069; A63B 21/015; A63B 21/225; A63B 22/0002; A63B 22/0005; A63B 22/0007; A63B 22/0015; A63B 22/0046; A63B 22/0605; A63B 69/16; A63B 2022/0611; A63B 2022/0623;
(Continued)

(56) References Cited

U.S. PATENT DOCUMENTS 59,915 A 11/1866 Lallement
363,522 A 5/1887 Knous
(Continued)

FOREIGN PATENT DOCUMENTS

CN 105620643 A 6/2016
DE 95019 1/1897
(Continued)

OTHER PUBLICATIONS

PCT International Search Report and Written Opinion, PCT/US17/50895 dated Jan. 12, 2018.

*Primary Examiner* — Joshua Lee
(74) *Attorney, Agent, or Firm* — Luedeka Neely Group, PC

(57) ABSTRACT

An adjustable rehabilitation and exercise device, including a rotary member rotatably mounted on a hub; a mount having a ring located adjacent to the rotary member with a lock selectively engageable with the rotary member to lock the ring at an angular position relative to the rotary member, and an arm connected to the ring and extending radially relative to the rotary member and having a movable carriage associated therewith to move radially relative to the rotary member and lockable to position the carriage at a radial position relative to the rotary member; and a patient engagement member connected to the mount and movable with the carriage.

7 Claims, 5 Drawing Sheets

(51) Int. Cl.

| | |
|---|---|
| ***A63B 21/00*** | (2006.01) |
| ***A63B 21/015*** | (2006.01) |
| ***A63B 69/16*** | (2006.01) |
| *A63B 21/22* | (2006.01) |

(52) U.S. Cl.
CPC ..... *A63B 22/0005* (2015.10); *A63B 22/0007* (2013.01); *A63B 2022/0611* (2013.01); *A63B 2022/0623* (2013.01); *A63B 2022/0635* (2013.01); *A63B 2069/161* (2013.01); *A63B 2220/30* (2013.01); *A63B 2225/09* (2013.01)

(58) Field of Classification Search
CPC ..... A63B 2022/0635; A63B 2069/161; A63B 2220/30; A63B 2225/09
See application file for complete search history.

(56) References Cited

U.S. PATENT DOCUMENTS

| | | | |
|---|---|---|---|
| 446,671 | A | 2/1891 | Elliott |
| 610,157 | A | 8/1898 | Campbell |
| 631,276 | A | 8/1899 | Bulova |
| 823,712 | A | 6/1906 | Uhlmann |
| 1,149,029 | A | 8/1915 | Clark |
| 1,227,743 | A | 5/1917 | Burgedorff |
| 1,784,230 | A | 12/1930 | Freeman |
| 3,081,645 | A | 3/1963 | Bergfors |
| 3,100,640 | A | 8/1963 | Weitzel |
| 3,137,014 | A | 6/1964 | Meucci |
| 3,143,316 | A | 8/1964 | Shapiro |
| 3,713,438 | A | 1/1973 | Knutsen |
| 3,888,136 | A | 6/1975 | Lapeyre |
| 4,079,957 | A | 3/1978 | Blease |
| 4,446,753 | A | 5/1984 | Nagano |
| 4,477,072 | A | 10/1984 | DeCloux |
| 4,509,742 | A | 4/1985 | Cones |
| 4,606,241 | A | 8/1986 | Fredriksson |
| 4,611,807 | A | 9/1986 | Castillo |
| 4,648,287 | A | 3/1987 | Preskitt |
| 4,673,178 | A | 6/1987 | Dwight |
| 4,850,245 | A | 7/1989 | Feamster et al. |
| 4,858,942 | A | 8/1989 | Rodriguez |
| 4,915,374 | A | 4/1990 | Watkins |
| 4,930,768 | A | 6/1990 | Lapcevic |
| 4,961,570 | A | 10/1990 | Chang |
| 5,027,794 | A | 7/1991 | Pyle |
| 5,161,430 | A | 11/1992 | Febey |
| 5,247,853 | A | 9/1993 | Dalebout |
| D342,299 | S | 12/1993 | Birrell et al. |
| 5,282,748 | A | 2/1994 | Little |
| 5,316,532 | A | 5/1994 | Butler |
| 5,324,241 | A | 6/1994 | Artigues et al. |
| 5,336,147 | A | 8/1994 | Sweeney |
| 5,338,272 | A | 8/1994 | Sweeney |
| 5,361,649 | A | 11/1994 | Slocum |
| 5,458,022 | A | 10/1995 | Mattfeld et al. |
| 5,566,589 | A | 10/1996 | Buck |
| 5,580,338 | A | 12/1996 | Scelta et al. |
| 5,676,349 | A | 10/1997 | Wilson |
| 5,685,804 | A | 11/1997 | Whan-Tong et al. |
| 5,860,941 | A | 1/1999 | Saringer et al. |
| 5,950,813 | A | 9/1999 | Hoskins et al. |
| 6,053,847 | A | 4/2000 | Stearns et al. |
| 6,077,201 | A | 6/2000 | Cheng |
| 6,102,834 | A | 8/2000 | Chen |
| 6,155,958 | A | 12/2000 | Goldberg |
| 6,253,638 | B1 | 7/2001 | Bermudez |
| 6,371,891 | B1 | 4/2002 | Speas |
| 6,430,436 | B1 | 8/2002 | Richter |
| 6,474,193 | B1 | 11/2002 | Farney |
| 6,543,309 | B2 | 4/2003 | Heim |
| 6,589,139 | B1 | 7/2003 | Butterworth |
| 6,640,662 | B1 | 11/2003 | Baxter |
| 6,820,517 | B1 | 11/2004 | Farney |
| 6,865,969 | B2 | 3/2005 | Stevens |
| 6,895,834 | B1 | 5/2005 | Baatz |
| 7,226,394 | B2 | 6/2007 | Johnson |
| 7,594,879 | B2 | 9/2009 | Johnson |
| 9,044,630 | B1 | 6/2015 | Lampert et al. |
| 9,480,873 | B2 | 11/2016 | Chuang |
| 2003/0092536 | A1 | 5/2003 | Romanelli et al. |
| 2004/0194572 | A1 | 10/2004 | Kim |
| 2005/0020411 | A1 | 1/2005 | Andrews |
| 2005/0085353 | A1 | 4/2005 | Johnson |
| 2005/0274220 | A1 | 12/2005 | Reboullet |
| 2006/0003871 | A1 | 1/2006 | Houghton et al. |
| 2008/0161166 | A1 | 7/2008 | Lo |
| 2009/0211395 | A1 | 8/2009 | Mul'e |
| 2012/0167709 | A1 | 7/2012 | Chen et al. |
| 2017/0113092 | A1 | 4/2017 | Johnson |

FOREIGN PATENT DOCUMENTS

| | | | |
|---|---|---|---|
| DE | 7628633 | U1 | 12/1977 |
| DE | 8519150 | U1 | 10/1985 |
| DE | 3732905 | A1 | 7/1988 |
| DE | 29620008 | U1 | 2/1997 |
| DE | 19619820 | C2 | 1/2001 |
| DE | 19947926 | A3 | 4/2001 |
| EP | 0199600 | A2 | 10/1986 |
| EP | 0634319 | B1 | 10/1999 |
| EP | 1034817 | A1 | 9/2000 |
| FR | 2527541 | A2 | 12/1983 |
| GB | 141664 | A | 11/1920 |
| GB | 2336140 | A | 10/1999 |
| GB | 2372459 | A | 8/2002 |
| WO | 9809687 | A1 | 3/1998 |
| WO | 2006012694 | A1 | 2/2006 |

ADJUSTABLE REHABILITATION AND EXERCISE DEVICE

CROSS-REFERENCE TO RELATED APPLICATION

This application claims priority to US Provisional Application No. 62/393,348 filed Sep. 12, 2016, entitled ADJUSTABLE REHABILITATION AND EXERCISE DEVICE, incorporated herein by reference in its entirety.

FIELD

This disclosure relates to the field of rehabilitation devices. More particularly, this disclosure relates to adjustable rehabilitation devices having improved connection and adjustability of patient engagement members.

BACKGROUND

Improvement is desired in the construction of adjustable rehabilitation and exercise devices. Adjustable rehabilitation and exercise devices having pedals on opposite sides and adjustably positionable relative to one another have been proposed. However, such designs require improvement due to the fact that the pedals tend to not remain securely mounted and detach, wobble and the like. In addition, it is desirable to provide for an adjustable rehabilitation or exercise device that is capable of providing both powered motion or user initiated motion without the need for separate devices.

Accordingly, in one aspect, the disclosure provides an adjustable rehabilitation and exercise device having patient engagement members on opposite sides of the device, which are adjustably positionable relative to one another both radially and angularly.

SUMMARY

The disclosure provides an adjustable rehabilitation and exercise devices.

In one aspect, an adjustable rehabilitation and exercise device includes a first rotary member rotatably mounted on a first hub; a second rotary member rotatably mounted on a second hub; a first mount having a ring located adjacent to the first rotary member with a lock selectively engageable with the first rotary member to lock the ring at an angular position relative to the first rotary member, and an arm connected to the ring and extending radially relative to the first rotary member and having a movable first carriage associated therewith to move radially relative to the first rotary member and lockable to position the first carriage at a radial position relative to the first rotary member; and a first patient engagement member connected to the first mount and movable with the first carriage.

The device also includes a second mount having a ring movably mounted relative to the second rotary member and having a lock selectively engageable with the second rotary member to lock the ring at an angular position relative to the second rotary member, and an arm connected to the ring and extending radially relative to the second rotary member and having a movable second carriage associated therewith to move radially relative to the second rotary member and lockable to position the second carriage at a radial position relative to the second rotary member; and a second patient engagement member connected to the second mount and movable with the second carriage.

The first and second mounts are positionable relative to one another on the first and second rotary members to enable adjustable positioning of the first and second patient engagement members radially relative to the first and second hubs of the first and second rotary members and angularly relative to one another.

In another aspect, an adjustable rehabilitation and exercise device includes a rotary member rotatably mounted on a hub; a mount having a ring located adjacent to the rotary member with a lock selectively engageable with the rotary member to lock the ring at an angular position relative to the rotary member, and an arm connected to the ring and extending radially relative to the rotary member and having a movable carriage associated therewith to move radially relative to the rotary member and lockable to position the carriage at a radial position relative to the rotary member; and a patient engagement member connected to the mount and movable with the carriage.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1A:
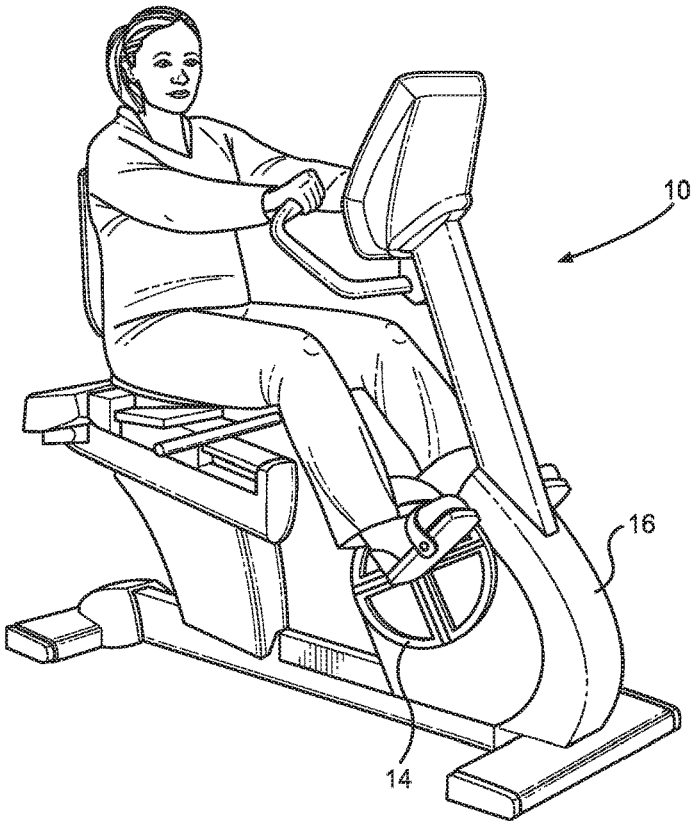
FIGS. 1A and 1B are perspective views of an adjustable rehabilitation and exercise device according to the disclosure configured to have adjustably positionable patient engagement members.
Figure 1B:
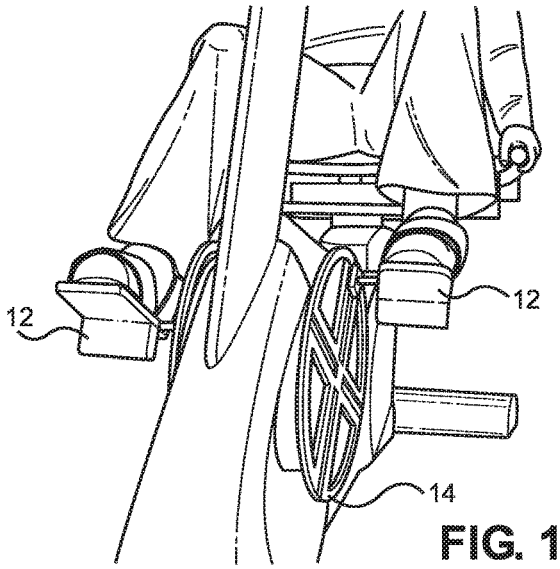
Figure 2A:
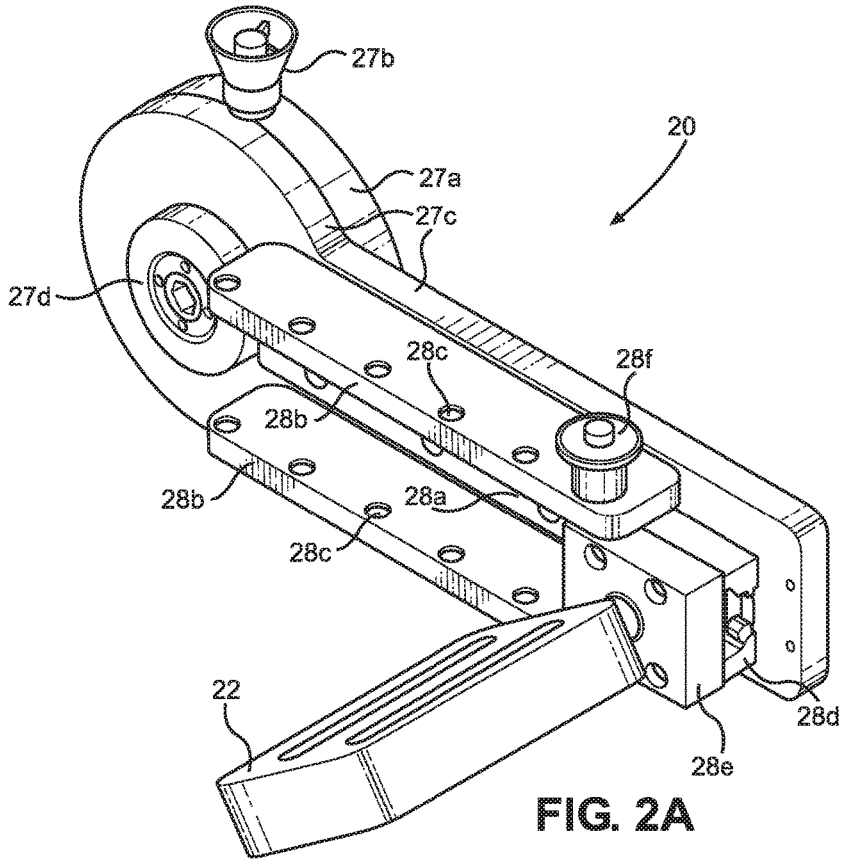
FIGS. 2A-2G show a wheel system for adjustably positioning a patient engagement member.
Figure 2B:
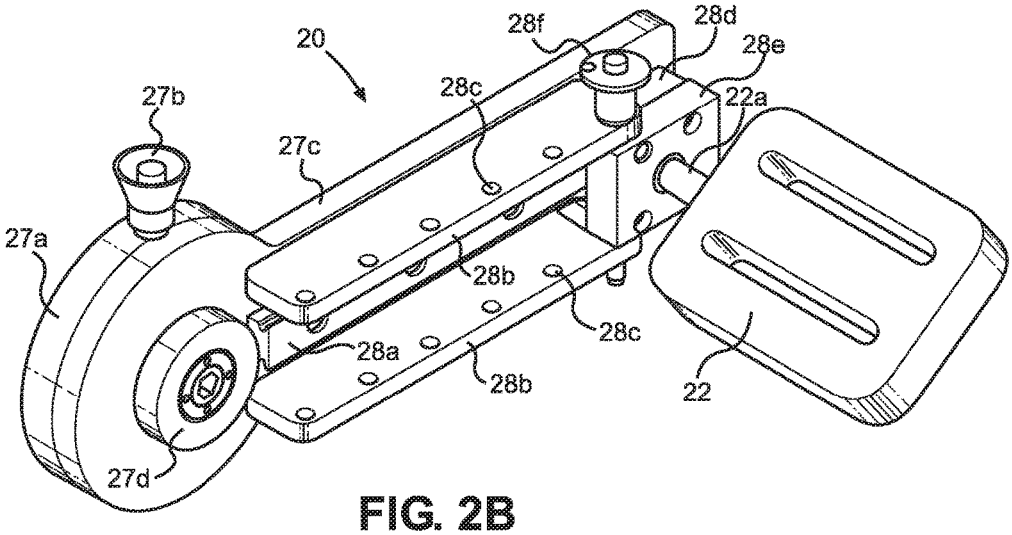
Figure 2C:
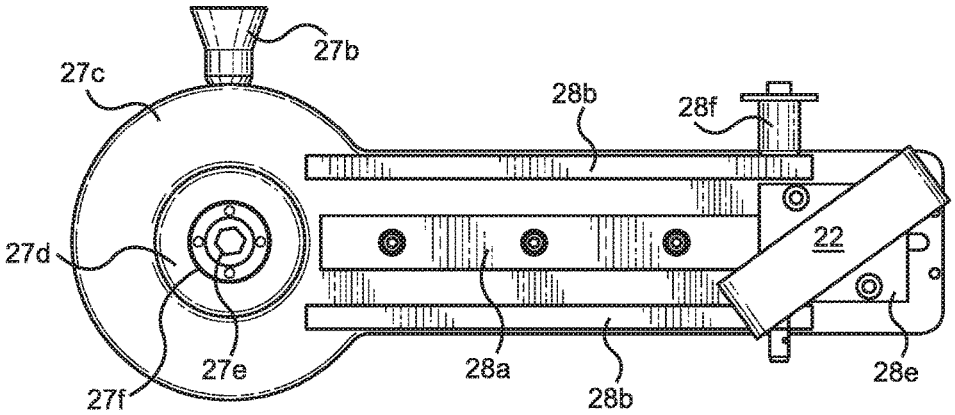
Figure 2D:
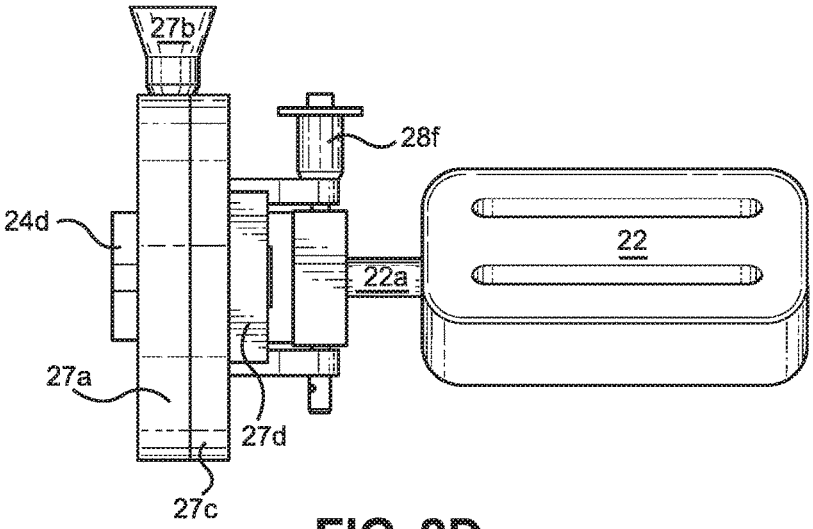
Figure 2E:
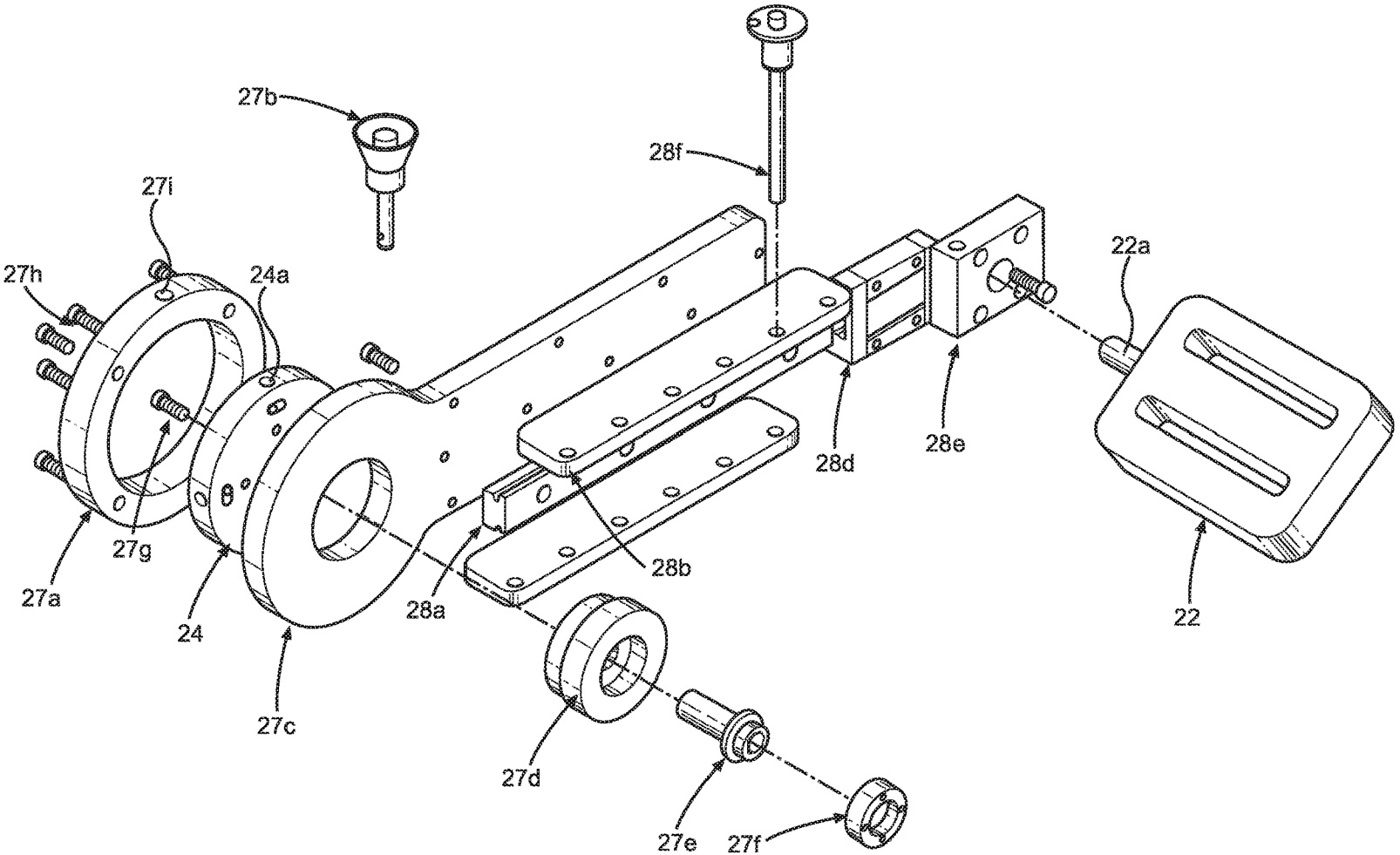
Figure 2F:
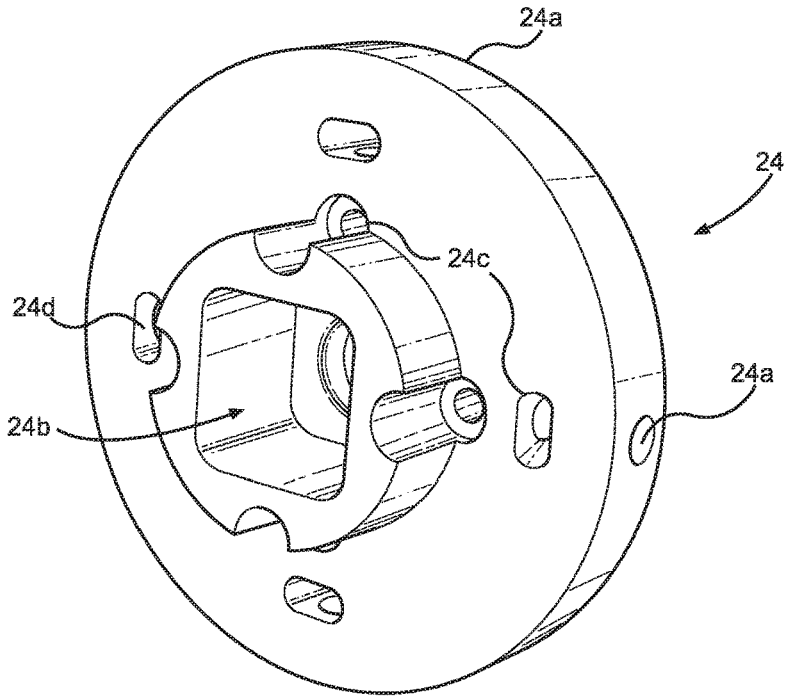
Figure 2G:
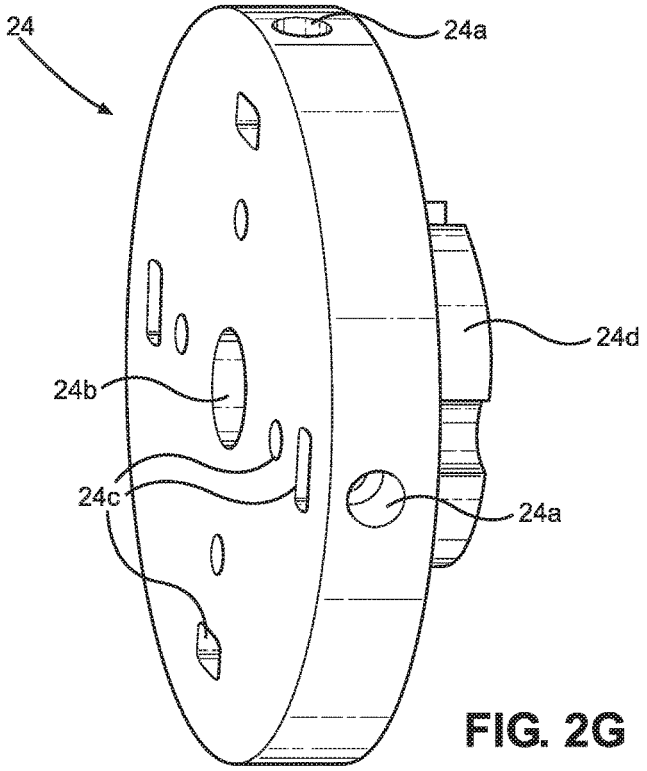

With initial reference to FIGS. 1A-1B, there is shown an adjustable rehabilitation and exercise device 10 having patient engagement members, such as pedals 12 on opposite sides that are adjustably positionable relative to one another, but securely mounted according to the disclosure to provide a more secure mounting that avoids disconnection, wobbling and the like often experienced with prior devices.

The device 10 includes a rotary device such as a wheel 14 or flywheel or the like rotatably mounted such as by a hub to a frame 16 or other support. The pedal 12 is configured for interacting with a patient to be rehabilitated and may be configured for use with lower body extremities such as the feet, legs, or upper body extremities such as the hands, arms and the like.

The pedal 12 may be a conventional bicycle pedal of the type having a foot support rotatably mounted onto an axle with bearings. The axle has exposed end threads for engaging a mount on the wheel 14 to locate the pedal on the wheel 14.

The wheel 14 may be configured to have both pedals 12 on opposite sides of a single wheel. However, a preferred construction, as seen in FIGS. 1A and 1B shows a pair of the wheels 14 spaced apart from one another but interconnected to a flywheel or the like.

The rehabilitation and exercise device 10 of FIGS. 1A-1B may take the form as depicted of a traditional exercise/rehabilitation device which is more or less non-portable and remains in a fixed location, such as a rehabilitation clinic or medical practice.

Alternatively, the device 10 may be configured to be smaller and more portable unit so that it is able to be easily transported to different locations at which rehabilitation or treatment is to be provided, such as a plurality of patient's homes, alternative care facilities or the like.

With reference to FIGS. 2A-2G, there is shown a wheel system 20 having a patient engagement member, such as a pedal 22 adjustably mounted on a wheel 24 by an adjustable mount 26. The wheel system 20 advantageously enables patient engagement members, such as pedals, to be radially and angularly adjustable relative to one another on opposite sides of an exercise device, such as the device 10.

The pedal 22 may be a conventional pedal and includes a support rotatably mounted on an axle 22*a*. The axle 22*a* has exposed threads for being received by a corresponding threaded aperture of the mount 26

The wheel 24 (FIGS. 2E-2G) is a disk configured to include a plurality of spaced apart apertures 24*a* located on the circumference of the wheel 24. The wheel 24 may also include a hub or central mounting aperture 24*b* for mounting of the wheel 24 to the device 10, and apertures 24*c* for connection of the wheel 24. The wheel also includes a nose 24*d*.

The mount 26 includes an angular adjustment system 27 and a radial adjustment system 28. The angular adjustment system 27 includes a ring 27*a*, a lock pin 27*b*, an arm 27*c*, a hub 27*d*, a hub fastener 27*e*, and a hub retainer 27*f*. The wheel 24 connects to the hub 27*d* by use of fasteners 27*g* which pass through the apertures 24*c* of the wheel and into corresponding apertures on the hub 27*d*.

The hub 27*d*, hub fastener 27*e* and the hub retainer 27*f* pivotally connect the arm 27*c* to the wheel 24. The ring 27*a* seats over the nose 24*d* of the wheel 24 and attaches to the arm 27*c* as by fasteners 27*h*. The lock pin 27*b* extends through an aperture 27*i* of the ring 27*a* to align with one of the apertures 24*a* of the wheel 24 to lock the angular relation of the arm 27*c* to the wheel 24.

To adjust the angular relationship of the arm 27*c*, and hence the pedal 22, to the wheel 24, the pin 27*b* located on the ring 27*a* is withdrawn from the aperture 27*i* and the angle adjusted by rotating the arm 27*b*. Once the angle is adjusted, the pin 27*b* is re-inserted through the aperture 27*i* to enter a different one of the apertures 24*a* of the wheel 24*a* that corresponds to the adjusted angle. The number of the apertures 24*a* may be selected to provide a desired increment of adjustment.

The radial adjustment system 28 includes a rail 28*a*, walls 28*b* having adjustment apertures 28*c*, carriage 28*d*, receiver 28*e*, and locking pin 28*f*. The rail 28*a* mounts to the arm 27*b* as by fasteners. The walls 28*b* are spaced apart above and below the rail 28*a*. The carriage 28*d* is slidably disposed on the rail 28*a*, with the receiver 28*e* affixed thereto to receive the axel 22*a* of the pedal 22, or other patient engagement member. The locking pin 28*f* extends through the apertures 28*c* of the walls 28*b* to fix the location of the carriage 28*d* and the receiver. The receiver 28*e* includes an aperture 28*g* for passage of the locking pin 28*f*.

To adjust the radial relationship of the pedal 22, the carriage 28*d* is moved along the rail 28*a*. The locking pin 28*f* is extended through the aperture 28*g* of the receiver 28*e* and the apertures 28*c* of the walls 28*b* to lock the radial location of the carriage 28*d*, and hence the pedal 22.

The mount 26 is configured to stably locate a patient engagement member and eliminate wobble and the like associated with conventional devices. In addition, the mount 26 is also configured to advantageously enable substantially incremental adjustment of the position of the mount.

The angular adjustment system 27 adjusts the angular position of the pedal 22, or other patient engagement member, relative to the wheel 24. The radial adjustment system 28 adjusts the radial position of the patient engagement member, relative to the wheel 24.

In combination, the angular adjustment system 27 and the radial adjustment system 28 enable radial and angular adjustment of the position of the pedal 22. When this manner of adjustment is used for both of the pedals on opposite sides of the device 10, the patient engagement members may be adjustably positioned relative to one another angularly, with each pedal being radially adjustable relative to the hubs of the wheels.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure

The invention claimed is:

1. An adjustable rehabilitation and exercise device, comprising:

a first rotary member rotatably mounted on a first hub;

a second rotary member rotatably mounted on a second hub;

a first mount having a ring located adjacent to the first rotary member with a lock selectively engageable with the first rotary member to lock the ring at an angular position relative to the first rotary member, and an arm connected to the ring and extending radially relative to the first rotary member and having a movable first carriage associated therewith to move radially relative to the first rotary member and lockable to position the first carriage at a radial position relative to the first rotary member;

a first patient engagement member connected to the first mount and movable with the first carriage;

a second mount having a ring movably mounted relative to the second rotary member and having a lock selectively engageable with the second rotary member to lock the ring at an angular position relative to the second rotary member, and an arm connected to the ring and extending radially relative to the second rotary member and having a movable second carriage associated therewith to move radially relative to the second rotary member and lockable to position the second carriage at a radial position relative to the second rotary member; and a second patient engagement member connected to the second mount and movable with the second carriage, wherein the first and second mounts are positionable relative to one another on the first and second rotary members to enable adjustable positioning of the first and second patient engagement members radially relative to the first and second hubs of the first and second rotary members and angularly relative to one another.

2. The device of claim 1, wherein the lock of the first ring is a pin.

3. The device of claim 1, wherein the patient engagement member is a pedal.

4. The device of claim 1, wherein the first mount further comprises a rail connected to the arm on which the carriage moves.

5. The device of claim 1, wherein the first mount further comprises a rail connected to the arm on which the carriage moves, and a pair of walls on opposite sides of the rail.

6. The device of claim 5, wherein the walls have spaced apart aligned apertures and a lock pin extendable therethrough to lock the position of the carriage.

7. An adjustable rehabilitation and exercise device, comprising:

a rotary member rotatably mounted on a hub;

a mount having a ring located adjacent to the rotary member with a lock selectively engageable with the rotary member to lock the ring at an angular position relative to the rotary member, and an arm connected to the ring and extending radially relative to the rotary member and having a movable carriage associated therewith to move radially relative to the rotary member and lockable to position the carriage at a radial position relative to the rotary member; and a patient engagement member connected to the mount and movable with the carriage.

* * * * *